US005088260A

United States Patent [19]

Barton et al.

[11] Patent Number: 5,088,260

[45] Date of Patent: Feb. 18, 1992

[54] SYSTEM AND METHOD FOR JOINING STRUCTURAL PANELS

[76] Inventors: James J. Barton, 2020 Bruck St., Columbus, Ohio 43207; Bonnie L. Skelly, P.O. Box 4340, East Providence, R.I. 02914

[21] Appl. No.: 556,151

[22] Filed: Jul. 23, 1990

[51] Int. Cl.[5] ..... E04B 2/10

[52] U.S. Cl. ..... 52/416; 52/415; 52/417; 52/745

[58] Field of Search ..... 52/415, 416, 417, 745

[56] References Cited

U.S. PATENT DOCUMENTS 3,180,058 7/1959 Tillisch et al. ..... 52/417

3,576,091 7/1969 Shull et al. ..... 52/417

*Primary Examiner*—Richard E. Chilcot, Jr.

*Assistant Examiner*—Wynn Wood

*Attorney, Agent, or Firm*—Vorys, Sater, Seymour & Pease

[57] ABSTRACT

A system and method regarding structural panels are disclosed which the structural panels have marginal edges with bevelled portions with increased surface area relative to non-bevelled edges. The bevelled surface areas are oriented in confronting relationship so as to define a longitudinal seam. An adhesive compound is provided in the seam. The adhesive compounds fills the volume between the opposing bevelled surfaces and provides sufficient shear and tensile strengths needed for joints. A finishing compound covers the adhesive compound wherein the finishing compound is compatible with both the adhesive compound and the structural panels.

6 Claims, 2 Drawing Sheets

SYSTEM AND METHOD FOR JOINING STRUCTURAL PANELS

CROSS-REFERENCE TO RELATED APPLICATION

This application relates to copending application Serial No. 07/556,150, entitled, "Structural Panel Having Edge Configurations", filed concurrently herewith.

BACKGROUND 0 THE INVENTION

The present invention relates generally to a joint system and method for joining structural panels together and, more particularly, a joint system and method for joining wallboard panels together in a manner which is less time consuming and easier than conventional methods.

Such conventional methods include a wide variety of approaches for joining together structural panels so that they can be readily and firmly secured to one another to form a partition. These approaches include use of mechanical fasteners, welding or bonding to effect the desired joint.

Wallboards, for instance, are a type of structural panel which are used in the building construction industry for purposes of forming partitions. In a conventional drywall or wallboard installation, the wallboards are secured to unfinished walls, such as wood studs by appropriate fasteners or suitable adhesives. Adjacent wallboard panels are positioned so that their edges are in abutting or confronting relationship to one another. Presently, a hydrosettable filler is normally utilized to cover or fill the joint existing between the adjacent panels. Some of the filler materials cure at least partially through evaporation and as much as 30% of its weight is comprised of water. Accordingly, there is significant shrinkage when using normal filler material and cracks appear in the joint area. The hydrosettable filler material generally requires that a reinforcing taping layer be applied thereto. This reduces the tendency of the filler material to crack upon drying. Moreover, since recessed nails, screws and staples are used to secure the wallboard panels to the unfinished walls, several applications of the filler are utilized. This, however, requires thorough sanding between each application of material so as to ensure a smooth appearance of the joint.

While the foregoing approach has been successful, there is on-going interest in the wallboard industry for improved means for jointing structural panels in a manner which is expeditious, inexpensive and requires less skill than known means.

SUMMARY OF THE INVENTION

In accordance with the present invention, there is provided an improved joint system and method for joining structural panels.

According to one aspect of the present invention, there is provided an improved method for jointing structural panels together. Included is a step of providing structural panels having mutually adjacent and opposing marginal edges which have edge means that form a pair of mutually opposing generally parallel bevelled surfaces which define a groove or seam for purposes of receiving therein a base adhesive compound. The base adhesive compound is applied to and between the bevelled edge surfaces so as to adhesively interlock the panels securely. The base adhesive compound is applied in bead form along the seam, and is thereafter spread to fill the seam smoothly over the abutting bevelled edges. The base adhesive compound is of the type which provides significant joint strength as well as provides for insulation for an impervious air and/or water seal. Applied over the spread base compound is an adequate amount of a joint compound to cover the base compound and facilitate providing a desired finished surface. According to the method of the present invention, the structural panels are wallboards which are expeditiously and simply joined together with a strong and durable joint.

Another aspect of the present invention relates to a joint system for use in joining structural panels. Included in the joint system is at least a pair of structural panels, such as wallboards, which have predetermined edge means with bevelled edges defining increased adherent surface areas. The bevelled edge surfaces are positioned adjacent to each other so that they mutually oppose each other and define a groove or seam. Another aspect of the system is the utilization of a base adhesive compound which is applied so as to adhere to and cover the mutually opposed bevelled edges of the wallboards. The system also includes a finish joint compound which is applied to the smoothed base compound which is compatible to not only the wallboard but the base compound as well. The joint compound is subsequently smoothed.

Among the other objects and features of the present invention are the provisions for an improved system and method for joining together wallboards which are easy and economical; an improved method for joining together partitions which does not require tape; the improved system and method of the foregoing type which utilize wallboards having mutually opposed tapered and bevelled marginal edges defining a seam into which an adhesive bonding material is introduced for adhering the two panels; the provisions of a system and method whereby the construction of walls utilizing wallboards can be joined together in significantly less time than known approaches; and the provisions for an improved method and system which allows for strong and durable joints.

The above and other objects and further scope of applicability of the present invention will become apparent when reading the following detailed description when taken in conjunction with the accompanying drawings, wherein like reference numerals indicate like structure throughout the several views.

DETAILED DESCRIPTION

Figure 1:
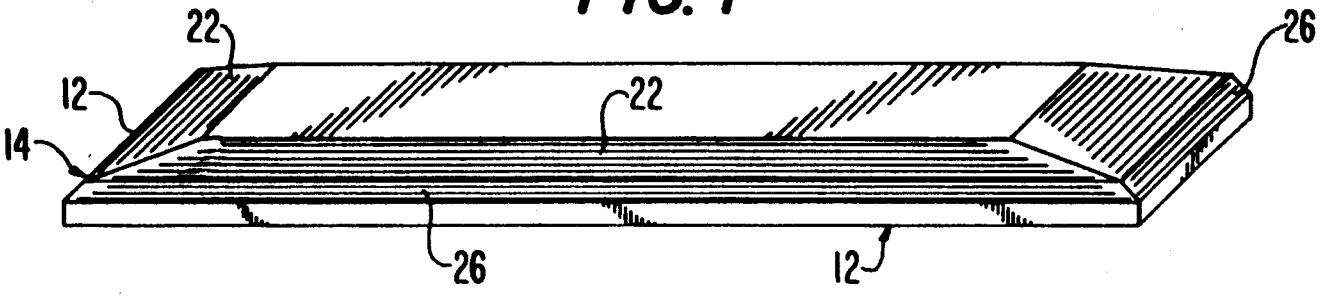
FIG. 1 is a perspective view of a fragmented end of a wallboard employing improved edge configurations made in accordance with the present invention.

Reference is made initially to FIG. 1 for depicting a portion of a structural panel which can be used in conjunction with forming the improved joint system 10 of the present invention. As used in the present specification and claims, the term structural panel includes panels which can be used for a variety of purposes including wall, flooring and ceiling partitions. The structural panel of this embodiment is a wallboard 12 of the kind described and claimed in copending U.S. application Serial No. 07/566,150, entitled STRUCTURAL PANEL HAVING EDGE CONFIGURATIONS. The wallboard 12 is different from traditional rectangular parallel-piped wallboard constructions because of the edge configurations 14 which are described more fully in the other noted application. Only the aspects of that wallboard necessary for understanding the present embodiment will be discussed. The wallboard 12 can be made of a wide variety of material which are conventionally used in the building industry. In this particular embodiment, however, the wallboard 12 is made of Gypsonite TM, which generally comprises a backing layer 16 made of paper and an outer layer 18 essentially made of a blend of gypsum and paper mache.

Figure 2:
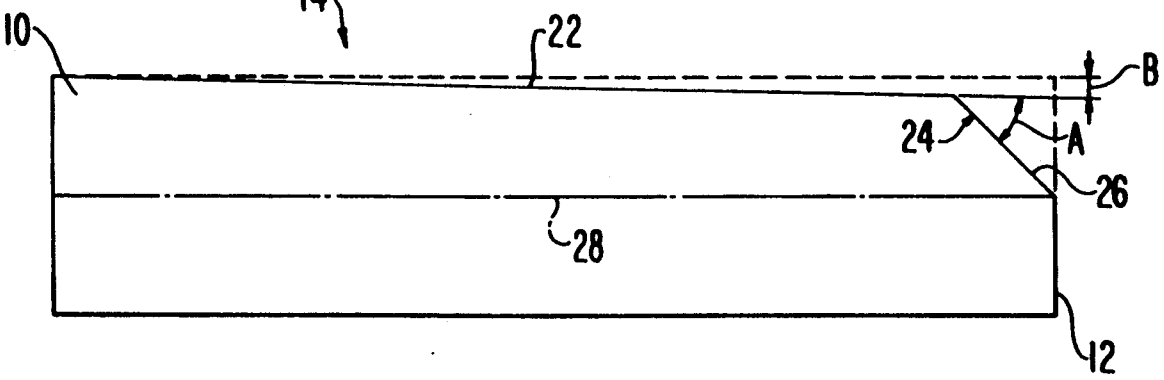
FIG. 2 is an enlarged and fragmented view of a segment of an edge means on a wallboard edge means.
Figure 3:
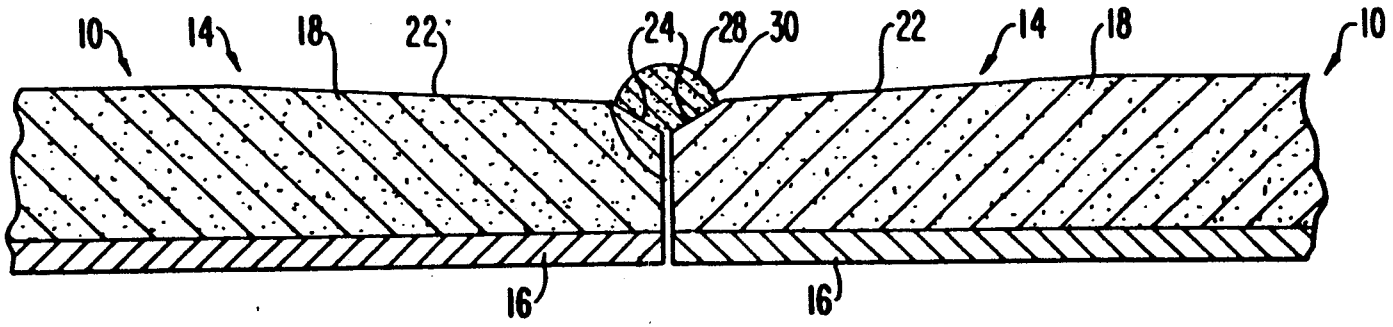
FIG. 3 is an enlarged and fragmented cross-sectional view of a pair of confronting edge configurations of wallboard having a bead of compound applied therebetween.
Figure 4:
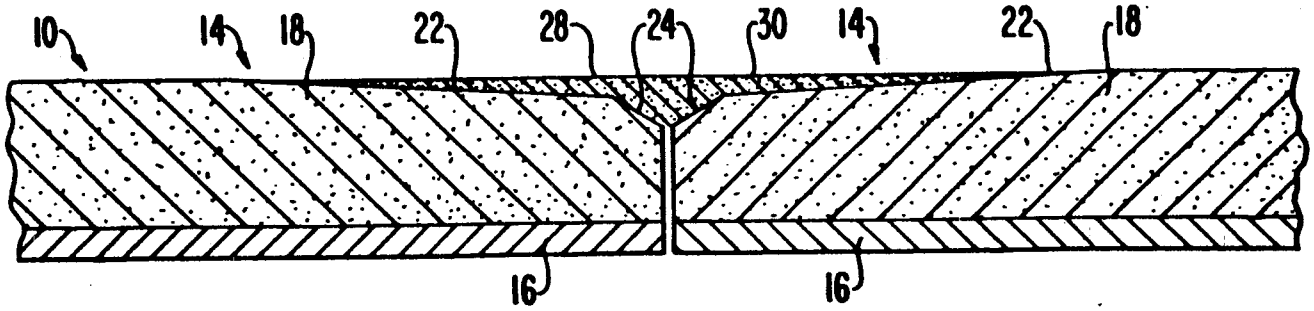
FIG. 4 illustrates a joint system including a pair of confronting wallboard edge configurations shown in FIG. 3 with a bead of base compound adhesive being spread.
Figure 5:
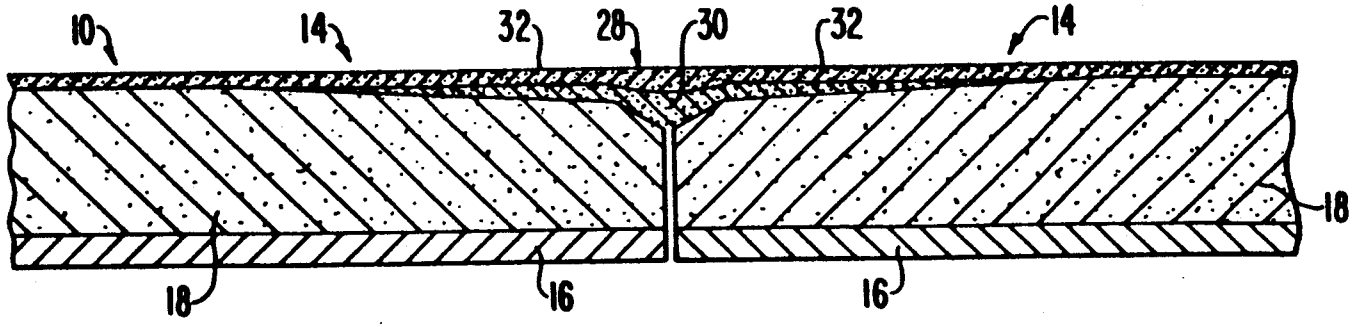
FIG. 5 is similar to FIG. 4, but illustrates a joint system having a joint compound applied in accordance with the present invention.

As shown in FIG. 2, the edge configuration 14 is provided with a tapered portion 22 and a bevelled edge 24 defining bevelled surface area 26. Mutually opposed bevelled edge portions 24 are placed into confronting relationship (See FIGS. 3–5). The bevelled edge portions 24 define a seam 28 which extends longitudinally along the extend of the confronting edge portions 24.

The joint system 10 includes an adhesive base compound 30 which is utilized to increase the bonding strength for the joint. Of course, the tapered and bevelled edge surfaces 22 and 26 are suitably cleaned prior to application of the base and joint compounds. Since the wallboard outer layer 18 includes gypsum, a PVAC type adhesive can be used. This adhesive, given the fact that there is increased surface area by virtue of the bevelled edge 24, promotes improved adhesive joint strength when the adhesive sets. It will be appreciated that although PVAC can be used because of its good intrinsic adhesion to gypsum type boards, it will be appreciated that the present invention contemplates other adhesives.

Also, it will be appreciated that if other building materials are used for the structural panel, other types of adhesives compatible therewith are to be used. Also, the PVAC adhesive base 20 has sufficient toolability and can easily fill 16 the seam 28. In this regard, PVAC is flexible after being applied such that, for example, it can be bent at room temperature without breaking.

After the adhesive base compound 30 has been applied, spread and smoothed as by a caulking gun and putty knife, into the seam 28, the joint compound 32 is applied over the adhesive base compound. The joint compound is selected should have sufficient strength to not only facilitate the adhesion strength of the joint, but also the joint compound should facilitate a subsequent finishing operation. The joint compound should cover the base compound as well as cover the tapered surfaces. A wide variety of joint compounds are contemplated, such as GOLDBOND ®. It will be appreciated that the selection for the type joint compound in combination with the adhesive is such as to yield performances which resist cracking and avoid the need for a reinforcing tape.

According to the present invention, it will be recognized that certain changes may be made in the above described system and method for joining structural panels without departing from the scope of the present invention herein involved. It is maintained that all matter contained in this description shall be interpreted as illustrative and not in a limiting sense.

We claim:

1. A method for joining structural panels together comprising the steps of providing:

a pair of structural panels having along at least one marginal edge thereof a bevelled portion with increases surface area relative to non-bevelled edges;

positioning said bevelled surface areas in substantially confronting relationships so as to define a longitudinal seam;

applying an adhesive compound in the seam to a depth sufficient to provide preselected shear and tensile strength needed for joints;

spreading the adhesive compound so as to substantially fill the volume between the opposing bevelled surfaces of said panels; and applying a finishing compound over the adhesive compound wherein the finishing compound is comparible with both the adhesive compound and the structural panels.

2. The method of claim 1 further comprising the preliminary step of preparing bevelled surfaces for the bonding adhesion material being applied thereto.

3. The method of claim 1 including the preliminary step of providing a wallboard having a gradually tapered section to said bevelled portion.

4. The method of claim 1 wherein the adhesive compound is PVAC.

5. The method of claim 3 wherein the base and finishing compounds are applied in an amount and manner sufficient in surface area, volume and depth to obtain desired drying.

6. A joint system for joining structural panels comprising:

at least pair of structural panels having mutually opposed bevelled surfaces which define a seam extending at least partially along the longitudinal extent thereof;

bonding adhesive means placed in and between said panels to a depth sufficient to provide predetermined shear and tensile strengths needed for the joint; and a finishing layer compound applied over the bonding adhesive and portions of the structural panel so as to increase adherence and facilitate finishing.

* * * * *